US005482124A

United States Patent [19]

Haussmann et al.

[11] Patent Number: 5,482,124

[45] Date of Patent: Jan. 9, 1996

[54] ROCK DRILL

[75] Inventors: August Haussmann, Oberzell; Bernhard Moser, Altshausen, both of Germany

[73] Assignee: Hawera Probst GmbH + Co., Ravensburg, Germany

[21] Appl. No.: 336,649

[22] Filed: Nov. 4, 1994

[30] Foreign Application Priority Data

Dec. 11, 1993 [DE] Germany ..... 43 42 324.8
Mar. 4, 1994 [DE] Germany ..... 44 07 119.1

[51] Int. Cl.[6] ..... E21B 10/36; E21B 10/44

[52] U.S. Cl. ..... 175/415; 175/420.1

[58] Field of Search ..... 175/420.1, 720, 175/419, 389, 415, 426

[56] References Cited

U.S. PATENT DOCUMENTS

| | | | |
|---|---|---|---|
| 2,976,944 | 3/1961 | Bassinger | 175/420.1 |
| 3,198,270 | 8/1965 | Horvath | 175/420.1 |
| 4,889,200 | 12/1989 | Moser | 175/394 |
| 4,903,787 | 2/1990 | Moser et al. | 175/420.1 |
| 4,951,761 | 8/1990 | Peetz et al. | 175/420.1 X |

FOREIGN PATENT DOCUMENTS

| | | |
|---|---|---|
| 0347602 | 12/1989 | European Pat. Off. . |
| 0281997 | 10/1991 | European Pat. Off. . |
| 0322565 | 1/1993 | European Pat. Off. . |
| 2074491 | 10/1971 | France . |
| 1916435 | 11/1970 | Germany . |
| 2756990 | 6/1979 | Germany . |
| 2912394 | 10/1980 | Germany . |
| 3020284 | 12/1981 | Germany . |
| 3025890 | 1/1982 | Germany . |
| 8104116 | 6/1982 | Germany . |
| 3538191 | 10/1985 | Germany . |
| 4306891A1 | 9/1994 | Germany . |

*Primary Examiner*—Hoang C. Dang
*Attorney, Agent, or Firm*—Spencer, Frank & Schneider

[57] ABSTRACT

A rock drill for hammer drilling machines is proposed, which has a helical shank and a drill head which is connected thereto and on whose end face are arranged a main cutting tip inclined in the shape of a roof and also auxiliary cutting tips disposed transversely thereto. The drill head has two laterally opposite flats for the formation of drilling dust grooves. In plan view the drill head has a very largely rectangular shape in cross section, an acute angle $\beta_1$ being enclosed between the main cutting tip and the trailing auxiliary cutting tips.

14 Claims, 3 Drawing Sheets

ROCK DRILL

BACKGROUND OF THE INVENTION

The invention relates to a rock drill for a hammer drilling machine. The rock drill comprises one of a single thread and a multi-thread discharge helix. A drill head is connected with the discharge helix and has an end face, and a cross-section taken approximately transverse to a longitudinal axis of the drill. The cross-section is defined by two mutually opposite, approximately axially parallel side flanks which form respective drilling dust grooves. A main cutting tip is arranged on the end face and extends over an entire diameter of the drill head to project radially beyond an outer circumferential contour thereof. The main cutting tip is comprised of a hard metal, and is inclined in a shape of a-roof as viewed relative to side thereof. Further, the main cutting tip includes two cutting edges. An auxiliary cutting tip is arranged transversely to the main cutting tip.

Rock drills having hard metal cutting tips are used for making holes in concrete, masonry, rock or the like. The drill head is in this case provided on its end face with at least one hard metal cutting tip, which generally extends over the entire diameter of the drill head and which through the rotary percussion or rotary hammering drive of the drill exerts a chisel action on the stone material which is to be comminuted. The diameter of the drilled hole is dictated by the outside diameter of the hard metal cutting tip. Such tools have the disadvantage that the cutting edges of only one cutting tip are subjected in the outer region to considerable wear through the heavy stressing, so that drilling progress soon declines.

In order to reduce the surface pressure on a single hard metal cutting tip and thus to lengthen the cutting edge life of the drill head, so-called cross cutting elements have become known, in which two auxiliary cutting tips are arranged at right angles to a main cutting tip (DE-A1 29 12 394). In this known tool the drill head has an approximately rectangular shape in cross section, with an inherently circular basic cross section with lateral flats to form spacious drilling dust grooves. These cross cutting elements are inserted symmetrically and centrally in the approximately rectangular cross section, that is to say the main cutting tip extends centrally and parallel to the two drilling dust clearance grooves. Such an arrangement of a drill head having a main cutting tip arranged parallel to the side surfaces of the drilling dust grooves, and also having auxiliary cutting tips disposed at right angles thereto, has the disadvantage that, because of the rectangular cross-sectional shape of the drill head, the auxiliary cutting tips in particular have only a very short length so as to not project too far into the drilling dust groove space. Consequently, the auxiliary cutting tips, whose operative diameter is shorter, cannot support the main cutting tip in the diameter region in which the diameter of the main cutting tip projects beyond the diameter of the auxiliary cutting tip. It is, however, precisely the regions of the main cutting tip which lie radially on the outside diameter that need support by the auxiliary cutting tips in order to improve the material removal work.

From EP 0 281 997 B1 or from EP 0 322 565 B1 rock drills have become known, which have a substantially square drill head cross section. The main cutting tip and two auxiliary cutting tips at right angles thereto connect the respective corner points of the square cross section. This arrangement has the advantage over the subject of the previously mentioned publication that the main and auxiliary cutting tips have approximately the same outside diameter, so that the auxiliary cutting tips form an effective support for the main cutting tip even in the radially outer region. Where the cross section in one exemplary embodiment of these known drilling tools changes from the square cross section and leads to a rectangular cross section, the subject of these known publications still retains an arrangement of the main cutting tip and the auxiliary cutting tips at right angles to one another. The auxiliary cutting tips in particular consequently lead into the side region of the drilling dust grooves and are possibly not given optimum support by the drill head.

SUMMARY OF THE INVENTION

The object on which the invention is based is that of improving the drill head geometry of the previously mentioned publications so as to provide a drilling tool having the largest possible drilling dust clearance grooves, while cross cutting elements having optimum action and cutting edge lives are integrated. Furthermore, the drill head geometry should be such that a manufacturing process entailing fewer problems is obtained, together with an improvement of efficiency.

Starting from a rock drill of the kind initially designated above, this object is achieved in accordance with the invention by providing the cross-section with one of a substantially rectangular and lozenge-shaped profile. The profile is defined by the two mutually opposite parallel side flanks and by two mutually opposite segment portions. Additionally, the auxiliary cutting tip is arranged at an acute angle relative to the main cutting tip. The acute angle is between about 60° and about 90°. The auxiliary cutting tip and the main cutting tip each pass diagonally through the cross-section, and each has a first side surface having an applied force acting thereupon, and a second side surface opposite to the first side surface. A radially outer region of at least-the second side surface of at least one of the auxiliary cutting tip and the main cutting tip is substantially entirely embedded in and supported by the drill head at at least the segment portions.

The central principle underlying the invention is that the largest possible drilling dust clearance groove can in particular be achieved if the cross section of the drill head has an approximately rectangular or lozenge-shaped configuration. The side flanks of the drilling dust groove, which are preferably directed parallel to the longitudinal axis of the drill, are arranged to lead relative to the main cutting tip in the direction of rotation of the drilling tool. The drilling dust groove is positioned directly in front of the main cutting tip. A large volume is thus obtained for the clearance of the drilling dust removed by the main cutting tip. Furthermore, the invention is based on the wider realization that the outside diameter of the auxiliary cutting tips should be made approximately equal in size to or only slightly smaller than the diameter of the main cutting tip, which forms the nominal diameter. The main cutting tip is thereby also effectively supported in its radially outer region by the auxiliary cutting tips, particularly in the axial removal of drilling dust. This realization gives rise to a very largely diagonal arrangement of the main cutting tip and of the aligned auxiliary cutting tips, which extend approximately through the corner points of a rectangular or lozenge-shaped cross section of the drill head. The arrangement of the main cutting tip and auxiliary cutting tip at right angles to one another, as provided in the above-described prior art, is thereby abandoned and an asymmetrical head geometry is selected, so that the invention adopts an acute angle between the main cutting tip and auxiliary cutting tips trailing in relation to the main cutting tip. In this arrangement the main cutting tip and in particular the auxiliary cutting tips are in an optimum manner supportingly embedded almost over their entire length in the drill head. This applies in particular also to cutting tip rear sides facing away from the load, although in this connection special features in respect of soldering techniques must be taken into account.

The asymmetrical distribution of the cutting tips has moreover the consequence of irregular action of the cutting edges in rotary percussion drilling, whereby the material removal power is markedly improved and the vibrations on the tool, and therefore on the machine, are markedly reduced. This produces an improvement in handling by the operator. With a symmetrical arrangement of the cutting tips, the cutting edges can always act in previously produced tool notches and thus lead to super-imposition of vibrations and reduction of drilling power. This is caused by conformity to a fixed, predetermined ratio of speed to number of blows of the hammer drill. This conformity is interrupted by an asymmetrical arrangement of the cutting tips.

Through the configuration and arrangement of the cross cutting elements in accordance with the invention, a defined drilled hole diameter is thus ensured, for example for faultless dowel fastening, while the main cutting tip, which is preferably slightly larger in its radial dimensions, is responsible for both the radial clearance work and the axial break-up work and the additional auxiliary cutting tips in particular assist the axial break-up work in the radially outer region of the drilled hole and thus counteract excessive wear on the main cutting tip in this outer region which is susceptible to wear.

This effect can be still further improved if the auxiliary cutting tips are in turn given a roof-like shape in side view, that is to say in a view of their wide side surface, while the radially outer roof slopes lie on the same lateral area of a cone as the cutting edges of the main cutting tip, which are likewise inclined in a roof shape. The radially inner cutting edge of the respective auxiliary cutting tip is in contrast set back axially, so that in this region the main cutting tip carries out the essential axial clearance work by a chisel action at a low circumferential speed.

In the manufacture-of the rock drill according to the invention consideration must also be paid to technical factors in respect of manufacture and, in particular, of soldering. This applies in particular to the soldering of the main cutting tip and auxiliary cutting tips into the drill head. In their radially outer region the cutting tips are particularly heavily stressed in the drilling work, so that the soldering must meet stringent requirements in order to ensure the durability of the soldered-in cutting tips. This is done by taking into account the correct mass proportions of the drill head on both sides of the respective cutting tip. At the same time attention is also preferably paid to optimization of the clearance of drilling dust.

BRIEF DESCRIPTION OF THE DRAWINGS

Exemplary embodiments of the invention are illustrated in the drawings and explained more fully in the following description, in which further advantages are indicated. In the drawings:

FIG. 2 shows a plan view of the rock drill shown in FIG. 1, as a first exemplary embodiment with an approximately rectangular drill head, while

DETAILED DESCRIPTION OF THE INVENTION

Figure 1:
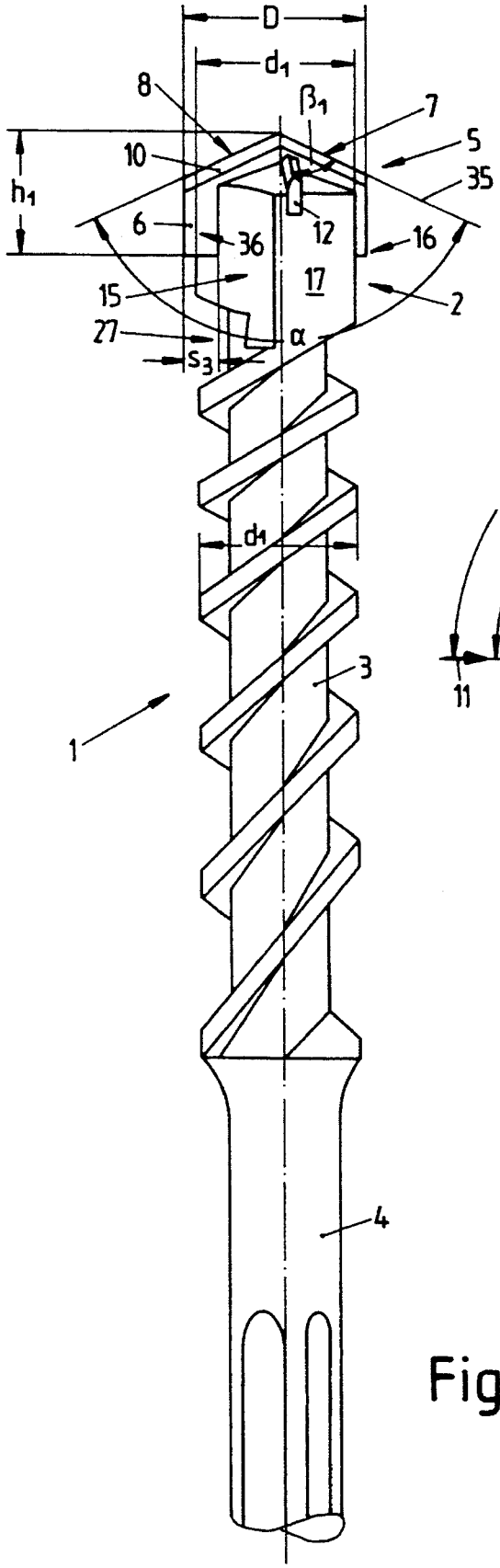
FIG. 1 shows a side view of the rock drill according to the invention, in a basic representation.
Figure 2:
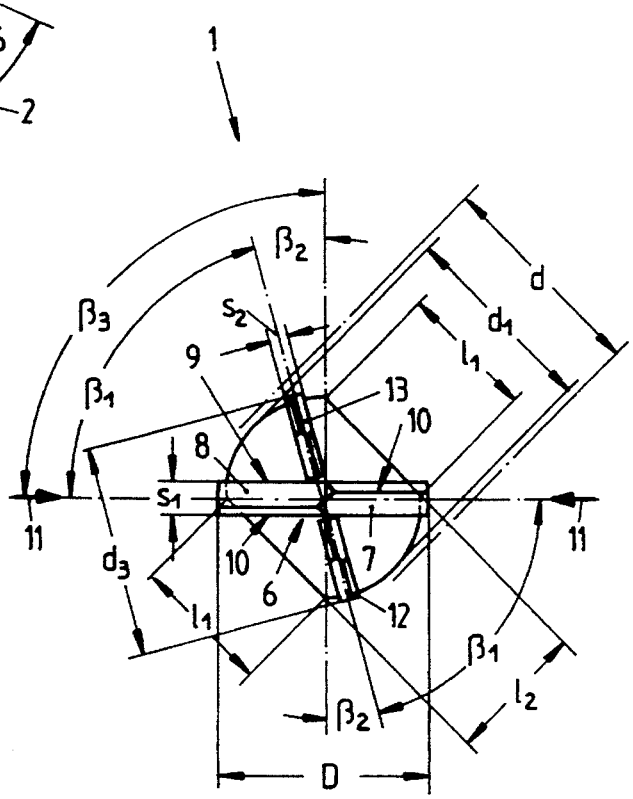
Figure 3:
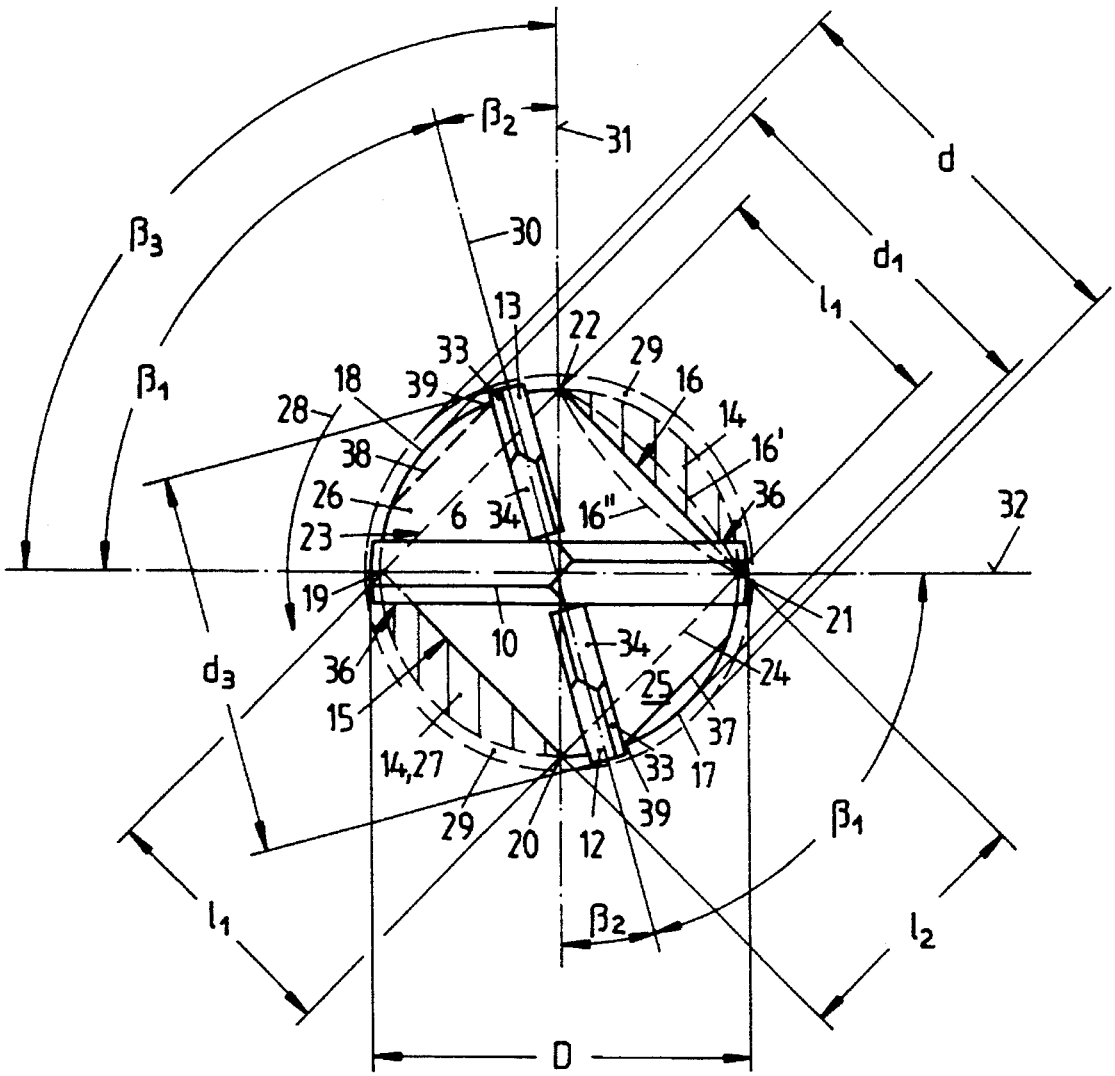
FIG. 3 shows an enlarged representation of FIG. 2 for the explanation of further details.

The rock drill 1 shown in side view in FIG. 1, and in plan view in FIGS. 2 and 3, consists of a drill head 2 together with an adjoining discharge helix 3, particularly a double-thread helix, and a clamping shank 4.

On its end face 5 situated axially at the front, the drill head has a main cutting tip 6 extending over the entire diameter D of the drill head 2, the diameter D constituting the drilled hole diameter or nominal diameter. The main cutting tip 6 is inclined in a roof shape, with a point angle $\alpha \approx 130°$, and has individual cutting edges 7, 8 which are arranged at 180° to one another. The main cutting tip 6 has a tip thickness $s_1$ (FIG. 2) and a height $h_1$. It is soldered in a continuous groove 9 in the drill head 2. As can be seen in particular in plan view or front view in FIGS. 2 and 3, the individual cutting edges 7, 8 of the main cutting tip 6 have in each case a roof-shaped ground surface 10, as viewed in the direction of the shorter end face (arrow 11).

In addition, the rock drill 1 has two auxiliary cutting tips 12, 13, which are arranged at an acute angle $\beta_1$ to the leading main cutting tip 6, the angle $\beta_1$ amounting approximately to $\beta_1 \approx 60°$ to 90° and in particular $\beta_1 \approx 75°$. The two auxiliary cutting tips 12, 13 are likewise designed as cutting elements which are roof-shaped in side view, as is explained more fully in the Applicant's EP 0 322 565 B1. Reference is therefore made to this publication. The auxiliary cutting tips 12, 13 therefore constitute a smaller embodiment of the main cutting tip 6.

As can be seen in FIGS. 1 to 3 and in particular in FIGS. 2 and 3, the cross section of the drill head 2 has a substantially rectangular shape, this cross section being obtained by lateral flattening of a circular-cylindrical cross section having the diameter $d_1$, the diameter $d_1$ corresponding to the helical shank diameter $d_1$ of the discharge helix 3. On round material of this kind two circular segments 14, lying laterally opposite one another, are cut off, so as to obtain the two approximately axially parallel side flanks 15, 16, which lie opposite one another and have a side length $l_1$, the segments 14 forming a part of the drilling dust groove. The approximately rectangular cross section of the drill head is accordingly formed by the two mutually opposite side flanks 15, 16 and by the two circular arc portions 17, 18 which connect the side flanks 15, 16 and which lie on the circle having the diameter $d_1$. As indicated in FIG. 3 for the side flank 16, the side flanks 15, 16 may also have a slightly convex (16') or slightly concave (16") outer surface.

The two end points-of the side flank 15 are given the reference numerals 19, 20, and the two end points of the side flank 16 the reference numerals 21, 22 in FIG. 3. The connection of the two mutually opposite side points 19, 22 forms the chord 23. A chord 24 is also formed by the connection of the corner points 20, 21. The length $l_2$ of the two chords 23, 24, and therefore the distance $l_2$ between the two side flanks 15, 16 extending parallel to one another, is approximately equal to the length $l_1$ of the side flanks 15, 16 themselves ($l_1 \approx l_2$), that is to say the corner points 19 to 22 lie approximately on a square cross section. The rectangular cross section is formed by a lateral arrangement of circular segment portions 25, 26 to form the two circular arc portions 17, 18.

The cross section of the drill head may however also have a still more elongated configuration, in which indicated in the main claim are possible. $l_1 > l_2$. In this case the passage area of the circular segments 14 becomes larger and the areas of the circular segment portions 25, 26 become smaller. The drilling dust clearance groove is thereby enlarged.

As can be seen in particular from FIG. 3, the main cutting tip 6 is situated diagonally in the square or rectangle formed by the corner points 19 to 22. In the exemplary embodiment the main cutting tip 6 approximately connects the corner points 19, 21, that is to say the chip space 27 formed inter alia by the circular segment surface 14 occupies a leading position, relative to the direction of rotation 28 of the tool, in front of the main cutting edge 10 of the main cutting tip 6. Here the radially outer cutting edge 36 of the main cutting tip 6 projects far into the drilling dust groove region (chip space) 27 (width $s_3$ in FIG. 1), so that considerable clearing work can be done. Accordingly, where the main cutting tip has its main material removal power, it is laid open in the direction of the drilling dust groove in order to deliver the drilling dust in optimum fashion into the drilling dust groove. On the rear side of the cutting edge 36 the main cutting tip 6 is however supported in optimum fashion in the drill head.

The main cutting tip 6 has a diameter D which leads to a drilled hole diameter d. The chip space 27 situated in front of the side flanks 15, 16 is accordingly formed by the circular segment portions 14 having the circle diameter $d_1$ together with a circular annular portion 29 having the diameter d.

The diameter D of the main cutting tip 6 or of the appertaining circle having the diameter d forms the nominal diameter of the drilled hole. Lateral projection beyond the helix diameter $d_1$ is selected in known manner; however, as will be subsequently discussed, at least the rear face of the cutting tips is substantially, entirely embedded in the drill head.

In FIGS. 2 and 3 it is also possible to see the arrangement of the two aligned auxiliary cutting tips 12, 13, which lie on a vertical plane 30. If another vertical plane 31 is laid through the corner points 20, 22 of the square or rectangle shown in FIG. 3 defined by the points 19 to 22, the vertical plane 30 is arranged to lead, relative to the vertical plane 31, by an angle $\beta_2$ in the direction of rotation 28, the angle having the value $\beta_2 \approx 10°$ to 20°, and in particular $\beta_2 \approx 15°$. If in the exemplary embodiment the two vertical planes 30, 31 were to coincide, this would give an arrangement of the main cutting tip 6 being at right angles to the auxiliary cutting tips 12, 13. The vertical plane 32 through the main cutting tip 6 accordingly forms an angle $\beta_1 \approx 60°$ to 90° and in particular $\beta_1 = 75°$ to the vertical plane 30 through the auxiliary cutting tips 12, 13. The angle $\beta_3$ between the vertical plane 32 extending through the corner points 19, 21 and the vertical plane 31 extending through the corner points 20, 22 amounts to approximately $\beta_3 \approx 90°$. Through this arrangement the leading main cutting tip and the trailing auxiliary cutting tips form an acute angle $\beta_1$. This gives inter alia the advantage that the auxiliary cutting tips 12, 13 lie within the respective circular segment portion 25, 26 and thus are laterally embedded in optimum fashion in their radially outer regions. If the two auxiliary cutting tips 12, 13 were to lie exactly in the vertical plane 31, their trailing flank portion, that is to say the flank portion directed towards the respective drilling dust groove 14, would be only inadequately supported by the drill head. Through the displacement of this portion into the circular segment portion 25, 26, optimum support of the auxiliary cutting tips 12, 13 by their radially outer region is also ensured.

The circular segment portion 25, 26 lying in front of the respective auxiliary cutting tip 12, 13 in the direction of rotation can as an alternative, if desired, be cut off, from the point of intersection 39 of the auxiliary cutting tip and the circular arc portion 17, 18, in the outward direction (line 37, 38), since this "residual segment portion" no longer has an essential supporting action. The alteration of the lines 37, 38 as external contour leads to the exemplary embodiment according to FIG. 4, as further described below.

In FIG. 3 the diameter $d_3$ of the two aligned auxiliary cutting tips 12, 13 is equal to or slightly smaller than the diameter D of the main cutting tip 6 ($d_3 \leqq D$). The diameter $d_3$ is preferably selected to be slightly smaller than the diameter of the main cutting tip 6 in order to leave the radial clearing work essentially to the main cutting tip 6 which has the greater thickness $s_1$. The radially outer cutting edges of the auxiliary cutting tips 12, 13, which in broadside view are likewise roof-shaped, accordingly serve essentially to support the axial clearing work of the drilling tool. Damage to the radially outer region of the auxiliary cutting tip, which has a substantially smaller thickness $s_2$, is thereby avoided.

In FIG. 3 the radially outer regions of the cutting tips 12, 13 are given the reference numeral 33 and the radially inner regions the reference numeral 34. The radially outer regions 33 lie on the same lateral area 35 of a cone formed by the rotating cutting edges of the main cutting tip 6 (FIG. 1). The two inner regions 34 of the respective auxiliary cutting tip 12, 13 extend downwards to the center of the drill in accordance with a roof angle $\alpha$ corresponding to the main cutting tip 6. The radially inner regions 34 may however also extend horizontally to the center of the drill from the center of the respective auxiliary cutting tip.

Figure 4:
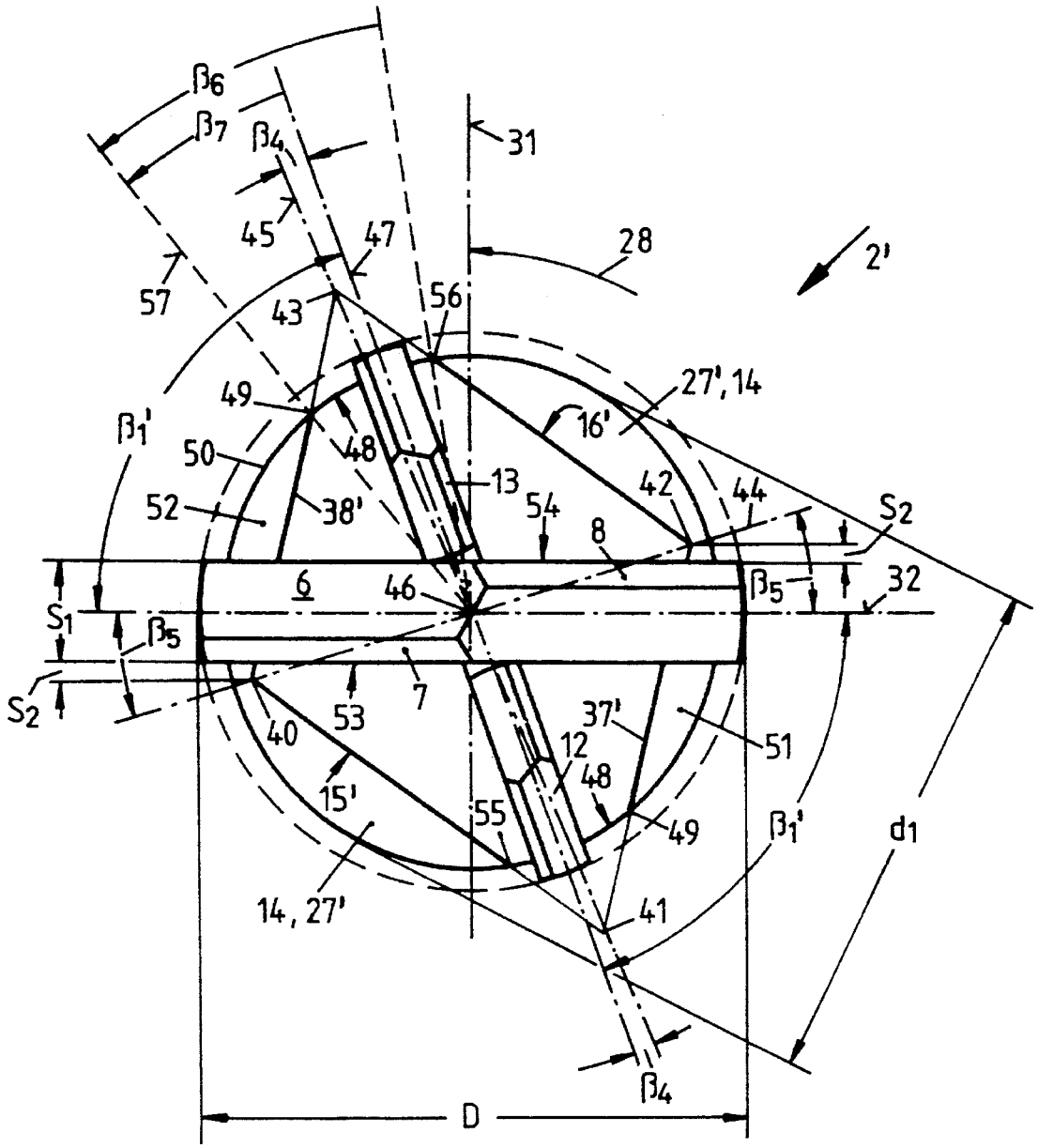
FIG. 4 shows another exemplary embodiment having an approximately lozenge-shaped drill head.

In FIG. 4 another exemplary embodiment of the invention is illustrated, in which the consequent further development of a head geometry according to the exemplary embodiment according to FIG. 3, particularly also in respect of soldering-technique, was effected. Like parts are designated by like reference numerals, so that reference is expressly made to the description of the exemplary embodiment according to FIG. 3. The rock drill according to FIG. 4, which is shown in plan view, has a drill head 2' having an approximately lozenge-shaped cross section, the corner points of the lozenge being given the reference numerals 40 to 43. The line connecting the lozenge points 40, 41 forms the side flank 15' of the drill head for the formation of the drilling dust groove or the chip space 27', and similarly the line connecting the corner points 42, 43 forms the side flank 16', arranged parallel to the side flank 15', for the formation of the opposite chip space 27'. In this arrangement the respective chip space lies within the circular segments 14 formed by the circumcircle having the diameter D.

The two corner points 41, 43 lie outside the circumcircle formed by the nominal diameter D, while the two corner points 40, 42 of the lozenge lie within the drill head diameter $d_1$.

The line 44 connecting the two lozenge corner points 40, 42 and the line 45 connecting the two lozenge corner points 41, 43 form a lozenge cross which extends through the center 46 of the drill head cross section or of the longitudinal axis of symmetry of the drilling tool. The connecting line 44 here extends almost at right angles to the longitudinal plane of symmetry 47 through the auxiliary cutting tips 12, 13, while the connecting line 45 forms with plan 47 an angle $\beta_4 \approx 2°$ to 5°. The axes 44, 45 are therefore not at right angles to one another.

The main cutting tip 6 of the exemplary embodiment according to FIG. 4 lies with its longitudinal plane of symmetry 32 set back, relative to the transverse axis 44 of the lozenge, by an angle $\beta_5 \approx 15°$ to 20°.

The region between the respective auxiliary cutting tip 12, 13 and the leading main cutting tip 7, 8 has in the exemplary embodiment according to FIG. 4 a configuration such that over approximately a third of the circular segment portion situated therebetween an arcuate path 48 is at first formed, which extends to the point 49 on the drill head circumcircle 50 having the diameter $d_1$. From this point 49 onwards the two axially parallel side flanks 37', 38' extend on the lozenge connecting lines 41, 42 and 40, 43 respectively to form the drill head. In this arrangement the side flanks 37', 38' extend parallel to one another. This provides an additional chip space or drilling dust space 51, 52, which lies between the side flanks 37', 38' and the circumcircle formed by the outside diameter D.

Through this arrangement of the side flanks 37', 38' and in particular through the extension of the side flanks by an amount $s_2$ beyond the opposite side edge 53, 54 of the main cutting tip 6 to the points 40, 42, complete lateral embedding of the main cutting tip is achieved without a tapered drill head region being formed, particularly in the front region of the individual cutting edges 7, 8 of the main cutting tip 6. The main cutting tip 6 is consequently embedded in the head in such a manner that approximately equal mass proportions exist on both sides on the drill head. In the heat treatment of the drill head for the purpose of carrying out the soldering operation no harmful internal stresses can therefore be produced in the drill head, or they are markedly reduced. The arrangement of the main cutting tip 6 in the region of the drill head lozenge indicated is consequently such that the drill head leads entirely into a side flank 37', 38', so that this side flank is extended by the amount $s_2$ on the opposite side of the main cutting tip. The side flanks, and in particular the front cutting edges 53, 54 of the side cutting edges 7, 8, consequently do not pass through the corners 40, 42 of the lozenge cross section, but are slightly set back by the amount $s_2$ in relation thereto. Stable, defined edges and surfaces are thereby formed for the soldering operation and prevent the existence there of a sharp point detrimental in thermal respects.

As mentioned, the side flanks 15', 16' for the formation of the main drilling dust grooves and the side flanks 37', 38' for the formation of auxiliary drilling dust grooves 51, 52 lie axially parallel in each case and, as a whole, parallel to one another in each case, so that they can be produced in one manufacturing operation per pair of sides.

The arrangement of the mutually aligned auxiliary cutting tips 12, 13 with their longitudinal plane of symmetry 47, in relation to the arrangement of the main cutting tip with its longitudinal plane of symmetry 32, is once again predetermined by the angle $\beta_1 \approx 70°$. The outside diameter of the auxiliary cutting tips 12, 13 lies approximately on the outside diameter D of the main cutting tip. The auxiliary cutting tips lie approximately with their longitudinal plane of symmetry 47 in the region of the longitudinal axis 45 of the lozenge, the longitudinal axis 45 of the lozenge being arranged to lead by the angle $\beta_4$ in the direction of rotation 28 of the drilling tool.

The auxiliary cutting tips 12, 13 are embedded on both flanks in the circular arc continued by the circular segment portion 48, while the end points 55, 56 on the circular arc form at the same time the end point of the side flanks 15', 16' in FIG. 4. The arc portions 49, 55 and 49, 56 respectively are characterized by $\beta_6 \approx 30°$. The angle $\beta_7 \approx 20°$ gives the leading angle from the longitudinal plane of symmetry 47 of the auxiliary cutting tips 12, 13 to the angle half line 57 through the point 49. The side flanks 37', 38' begin from this point 49.

The drill head diameter $d_1$ in FIG. 4 forms at the same time the helical shank diameter, as illustrated in FIG. 1.

In explanation of further details of the invention reference is explicitly also made to the technical features which can be seen from the drawings. The invention is not however restricted to the exemplary embodiment described and illustrated. On the contrary, it also includes all developments and improvements which are within the capacity of those skilled in the art, within the scope of the principle of the invention.

We claim:

1. A rock drill for a hammer drilling machine, comprising:

one of a single-thread and a multi-thread discharge helix;

a drill head connected with said discharge helix and having an end face, and a cross section taken approximately transverse to a longitudinal axis of said drill, the cross section having one of a substantially rectangular and lozenge-shaped profile defined by two mutually opposite, approximately axially parallel side flanks forming respective drilling dust grooves and by two mutually opposite segment portions;

a main cutting tip arranged on said end face and extending over an entire diameter of said drill head to project radially beyond an outer circumferential contour thereof, and being comprised of a hard metal, said main cutting tip further being inclined in a shape of a roof as viewed relative to a side thereof, and including two cutting edges; and an auxiliary cutting tip arranged transversely to said main cutting tip at an acute angle between about 60° and about 90°; said auxiliary cutting tip and said main cutting tip each passing diagonally through said cross section, and each having a first side surface having an applied force acting thereupon, and a second side surface opposite to said first side surface; a radially outer region of at least the second side surface of said auxiliary cutting tip and said main cutting tip being substantially entirely embedded in and supported by said drill head at at least said segment portions.

2. The rock drill as defined in claim 1, wherein said segment portions are planar.

3. The rock drill as defined in claim 1, wherein said segment portions are circular.

4. The rock drill as defined in claim 1, wherein said side flanks each have a first length, and are separated by one another by a distance having a second length approximately equal to the first length.

5. The rock drill as defined in claim 1, wherein said acute angle is about 75°.

6. The rock drill as defined in claim 1, wherein a diameter of a circle circumscribing said main cutting tip is larger than a diameter of a circle circumscribing said auxiliary cutting tip.

7. The rock drill as defined in claim 6, wherein the diameter of the circle circumscribing said auxiliary cutting tip is approximately equal to the diameter of said drill head.

8. The rock drill as defined in claim 1, wherein said side flanks are one of planar, convexly arched, and concavely curved.

9. The rock drill as defined in claim 1, wherein said auxiliary cutting tip comprises at least two individual tips each having a roof shape as viewed relative to a broadside thereof; the radial outer region of said individual tips, and said cutting edges of said main cutting tip each lying on the same lateral area of a cone.

10. The rock drill as defined in claim 1, wherein said main cutting tip has a wall thickness greater than a wall thickness of said auxiliary cutting tip.

11. A rock drill for a hammer drilling machine, comprising:

one of a single-thread and a multi-thread discharge helix;

a drill head connected with said discharge helix and having an end face, and a cross section taken approximately transverse to a longitudinal axis of said drill and defining two mutually opposite, approximately axially parallel side flanks forming respective drilling dust grooves, the cross section having a substantially lozenge-shaped profile with two oppositely located corners being one of cut off and rounded off at a circumcircle to define a drill head diameter;

a main cutting tip arranged on said end face and extending over the entire diameter of said drill head to project radially beyond an outer circumferential contour thereof, and being comprised of a hard metal, said main cutting tip further being inclined in a shape of a roof as viewed relative to a side thereof, and including two cutting edges; and an auxiliary cutting tip arranged transversely to said main cutting tip at an acute angle between about 60° and about 90°, and having a vertical longitudinal plane of symmetry passing through an area corresponding to the one of the cut off and rounded off oppositely located corners, said auxiliary cutting tip and said main cutting tip each passing diagonally through said cross section.

12. The rock drill as defined in claim 11, wherein the lozenge-shaped profile has two additional oppositely located corners arranged along an axis transverse to the longitudinal plane of symmetry, and being located within the circumcircle defining the drill head diameter.

13. The rock drill as defined in claim 11, wherein the two parallel side flanks form a main chip space in front of said main cutting tip relative to a direction of rotation of said rock drill; and wherein the cross section of said drill head defines two additional mutually opposite, approximately axially parallel side flanks forming respective auxiliary drilling dust grooves.

14. The rock drill as defined in claim 11, wherein a thickness of said main cutting tip is arranged to lie completely within a side of the lozenge-shaped profile; and wherein said drill head has essentially equal mass proportions on lateral sides of at least one of said main cutting tip and said auxiliary cutting tip.

* * * * *